US009097497B2

(12) United States Patent
Corsetti

(10) Patent No.: US 9,097,497 B2
(45) Date of Patent: Aug. 4, 2015

(54) WINDOW GUARD AND DEFENSIVE BARRIER DEVICE

(71) Applicant: Nino Corsetti, Frankfort, IL (US)

(72) Inventor: Nino Corsetti, Frankfort, IL (US)

( * ) Notice: Subject to any disclaimer, the term of this patent is extended or adjusted under 35 U.S.C. 154(b) by 127 days.

(21) Appl. No.: 13/828,413

(22) Filed: Mar. 14, 2013

(65) Prior Publication Data

US 2014/0260934 A1 Sep. 18, 2014

(51) Int. Cl.

| | |
|---|---|
| ***F41H 5/24*** | (2006.01) |
| ***F41H 5/26*** | (2006.01) |
| ***F41H 5/08*** | (2006.01) |
| ***F41H 5/12*** | (2006.01) |

(52) U.S. Cl.

CPC .. *F41H 5/26* (2013.01); *F41H 5/08* (2013.01); *F41H 5/12* (2013.01)

(58) Field of Classification Search

CPC ..... F41H 5/24; F41H 5/013; F41H 5/26; E06B 5/106

USPC ..... 89/36.04, 36.05, 36.07, 36.09; 296/187.07

See application file for complete search history.

(56) References Cited

U.S. PATENT DOCUMENTS

| | | | | | |
|---|---|---|---|---|---|
| 1,659,249 | A * | 2/1928 | Entenman | 52/204.51 |
| 1,881,779 | A * | 10/1932 | Madsen | 52/204.51 |
| 2,317,392 | A * | 4/1943 | Lord | 89/36.07 |
| 2,611,934 | A * | 9/1952 | Milone | 52/204.51 |
| 2,828,512 | A * | 4/1958 | Stuckey | 52/204.51 |
| 5,572,839 | A * | 11/1996 | Kinsey | 52/204.51 |
| 5,887,391 | A * | 3/1999 | Shoup | 52/202 |
| 7,789,010 | B2 * | 9/2010 | Allor et al. | 89/36.03 |
| 8,001,880 | B2 * | 8/2011 | White et al. | 89/36.04 |
| 8,418,595 | B1 * | 4/2013 | Saucedo et al. | 89/36.07 |
| 2003/0167911 | A1 * | 9/2003 | White | 89/36.07 |
| 2011/0011255 | A1 * | 1/2011 | Kleniatis et al. | 89/36.09 |
| 2012/0174768 | A1 * | 7/2012 | Spransy | 89/36.09 |
| 2013/0205983 | A1 * | 8/2013 | Martin | 89/36.07 |
| 2014/0238225 | A1 * | 8/2014 | Mickiewicz | 89/36.07 |

* cited by examiner

*Primary Examiner* — Samir Abdosh

(74) *Attorney, Agent, or Firm* — Davis M. Chin, Jr.; Davis Chin

(57) ABSTRACT

A window guard and defensive barrier device for protecting and/or shielding personnel within the interior of a building structure against firing of projectiles through a window opening includes a movable upper panel member pivotally connected by a hinge device to a fixed lower panel member and being rotatable for covering the window opening. Gas spring mechanisms are used for facilitating the rotation of the upper panel member between a stowed position and a deployed position. A locking device is used for maintaining the upper panel member in the deployed position.

5 Claims, 6 Drawing Sheets

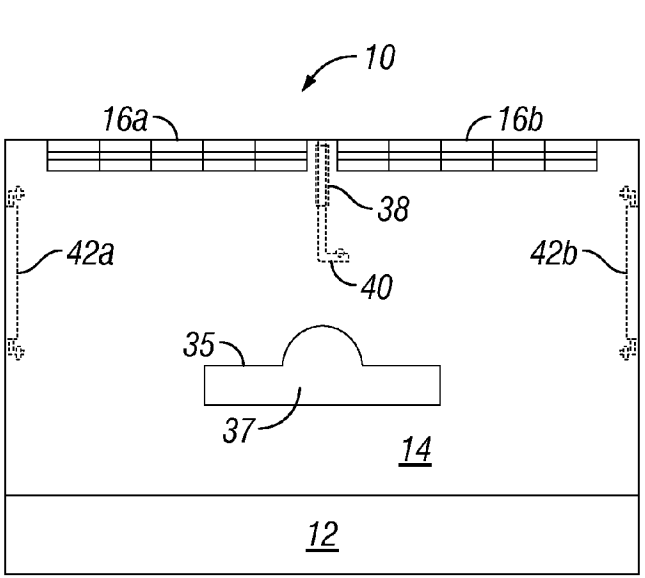
FIG. 4
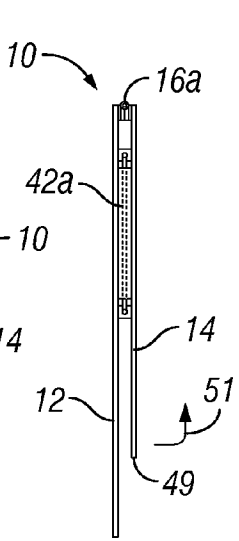
FIG. 5
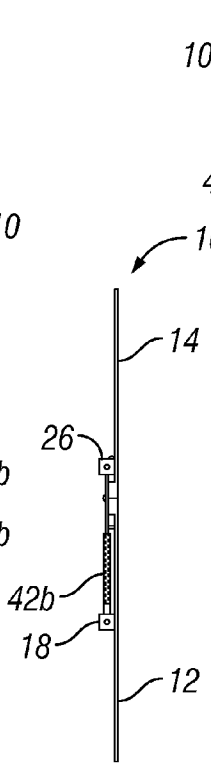
FIG. 3
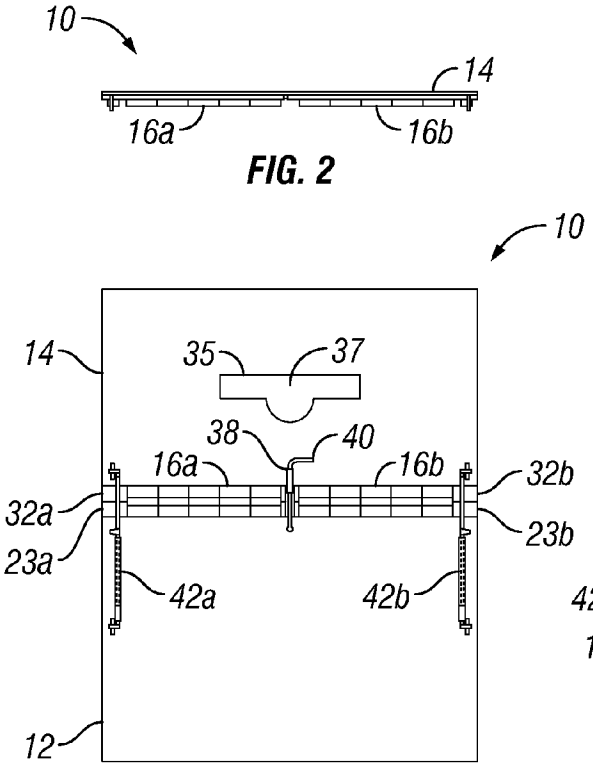
FIG. 1
FIG. 2

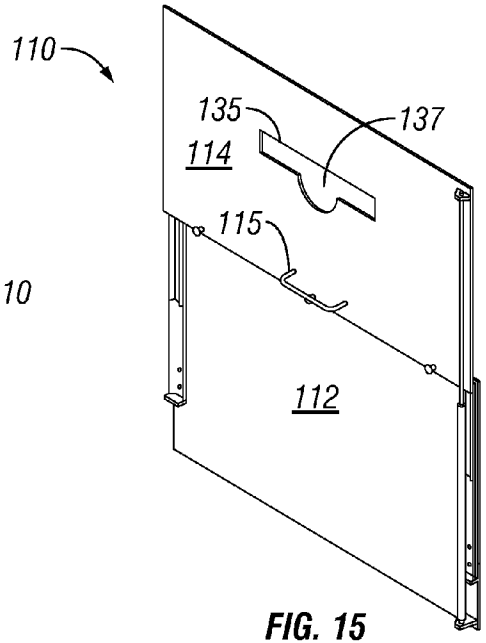
FIG. 15
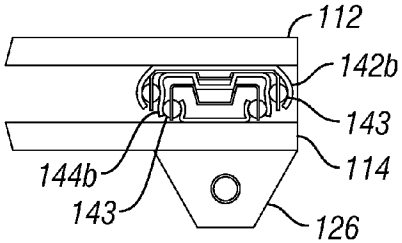
FIG. 14
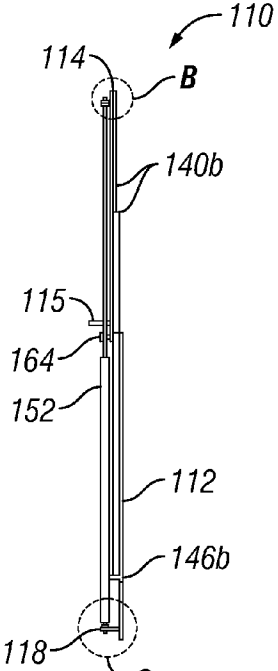
FIG. 9
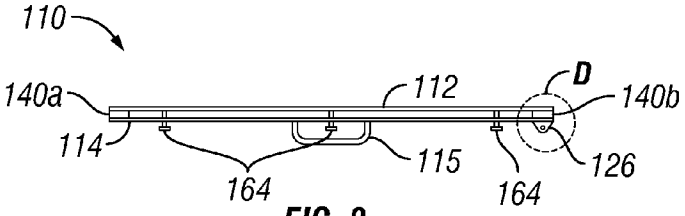
FIG. 8
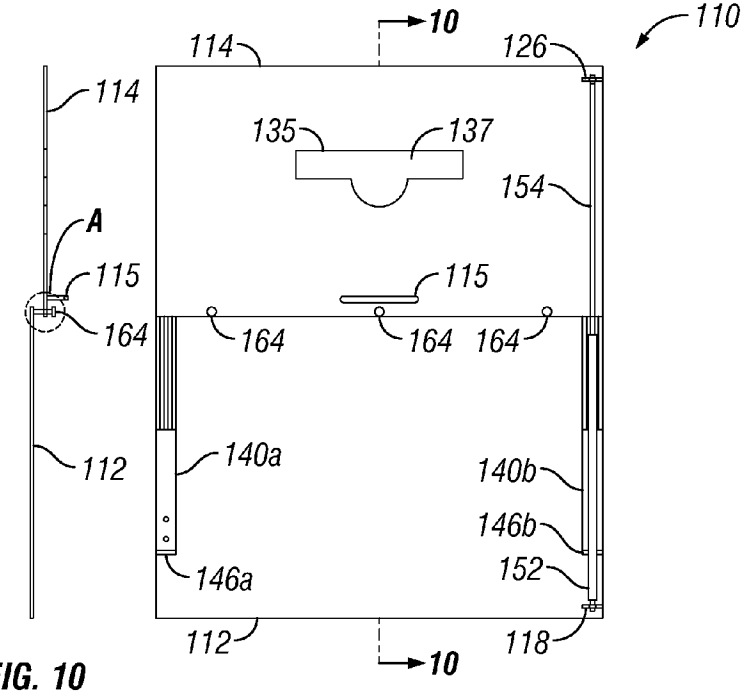
FIG. 7
FIG. 10

WINDOW GUARD AND DEFENSIVE BARRIER DEVICE

CROSS-REFERENCE TO RELATED APPLICATIONS

This application is a non-provisional application which claims the benefits of provisional application Ser. No. 61/681,243 filed on Aug. 9, 2012.

BACKGROUND OF THE INVENTION

1. Technical Field

This invention relates generally to window barrier apparatuses. More particularly, it relates to a window guard and defensive barrier device for protecting and/or shielding family members or personnel located within the interior of a building structure or room against firing of projectiles through a window opening.

2. Prior Art

As is generally well known, windows are typically allowed to be opened or closed in residential and industrial buildings. These windows are provided with transparent panels so as to permit the entrance of sunlight and the passage of air for ventilation. Also, these windows may sometimes perform the function of being emergency exits in the event of a fire and the like. However, in the current and unpredictable world environment the security of the building and the safety of the people therein are thus compromised or threatened due to the relative ease by which an aggressor equipped with guns, rifles, and the like can fire projectiles through the window opening and into the interior of the building.

In view of the present global conditions, there exist a great demand for a window guard and defensive barrier device for providing of security and protection to family members and/or personnel located within residential or commercial building from assault by an aggressor carrying firearms. In order to be completely efficient and effective, the window barrier device should be capable of being installed easily and quickly into the space of the window opening. It would also be desirable that the window barrier device be made of a durable construction. Further, the window barrier device should be relatively economical to manufacture and easy to assemble.

BRIEF SUMMARY OF THE INVENTION

It is therefore an object of the present invention to provide a window guard and defensive barrier device for protecting and/or shielding personnel against fired projectiles which is capable of being installed easily and quickly into the space of a window opening. It is another object of the present invention to provide a window guard and defensive barrier device which is made of a durable construction. It is still another object of the present invention to provide a barrier device which is relatively economical to manufacture and easy to assembly. These and other objects, features and advantages of the invention are provided by a window guard and defensive barrier device for protecting and/or shielding personnel within the interior of a building structure against firing of projectiles through a window opening which includes a fixed lower panel member formed of a ballistic, bullet-proof material and a movable upper panel member also formed of a ballistic, bullet-proof material.

Advantageously, a hinge device is used for pivotally connecting the movable upper panel member to the fixed lower panel member so as to permit the rotation of the movable upper panel member relative to the fixed lower panel member for covering the window opening. Further, gas spring mechanisms are operatively connected to the upper and lower panel members for facilitating the rotation of the upper panel member between a stowed position and a deployed position. In addition, a locking device is formed on the upper panel member and is movable into contact engagement with the lower panel member for maintaining the upper panel member in the deployed position.

These and other features and advantages of the disclosed window guard and defensive barrier device reside in the construction of parts and the combination thereof, the mode of operation and use, as will become more apparent from the following description, reference being made to the accompanying drawings that form a part of this specification wherein like reference characters designate corresponding parts in the several views. The embodiments and features thereof are described and illustrated in conjunction with systems, tools and methods which are meant to exemplify and to illustrate, not being limiting in scope.

BRIEF DESCRIPTION OF THE SEVERAL VIEWS OF THE DRAWING

FIG. 1 is front plan view of a first embodiment of a window guard and barrier device in the deployed position, constructed in accordance with the principles of the present invention;

FIG. 2 is top end view of the barrier device of FIG. 1;

FIG. 3 is right side view of the barrier device of FIG. 1;

FIG. 4 is front plan view of the window guard and barrier device of FIG. 1 in the stowed position;

FIG. 5 is a left side view of the barrier device of FIG. 4;

FIG. 7 is front plan view of a second embodiment of a window guard and barrier device in the deployed position, constructed in accordance with the principles of the present invention;

FIG. 8 is top end view of the barrier device of FIG. 7;

FIG. 9 is right side view of the barrier device of FIG. 7;

FIG. 10 is cross-sectional view, taken along the lines 10-10 of FIG. 7;

FIG. 14 is an enlarged view of the encircled portion D of FIG. 8;

FIG. 15 is a perspective view of the barrier device of FIG. 7;

DETAILED DESCRIPTION OF THE INVENTION

Figure 23:
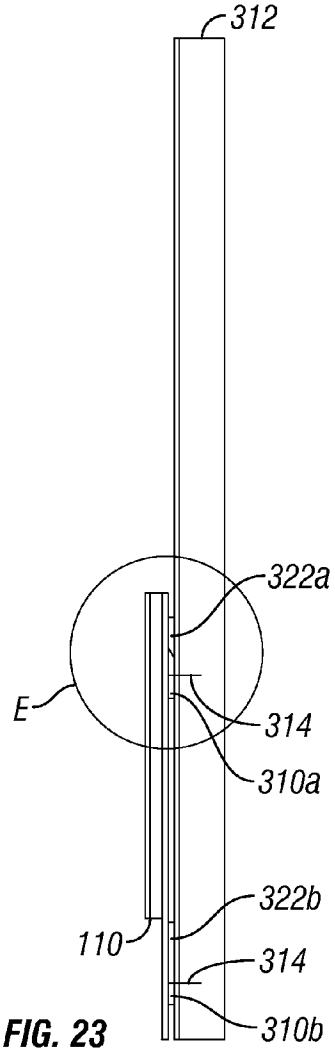
FIG. 23 is a right side view of the barrier device in FIG. 22.

Before explaining the disclosed embodiments in detail, it is to be distinctly understood at the outset that the present invention shown in the drawings and described in detail in association with a window guard and defensive barrier device is not intended to serve as a limitation upon the scope or teachings thereof, but is to be considered merely for the purpose of convenience of illustration of one example of its application.

Referring now in detail to the various views of the drawings and in particular to FIGS. 1 through 6, there is illustrated a window guard and defensive barrier device or assembly which is designated generally by reference numeral 10 and is constructed in accordance with the principles of the present invention. The window guard and defensive barrier device 10 is designed to be of a unique, simplified construction, which is relatively economical to manufacture and easy to assemble and install.

Figure 6:
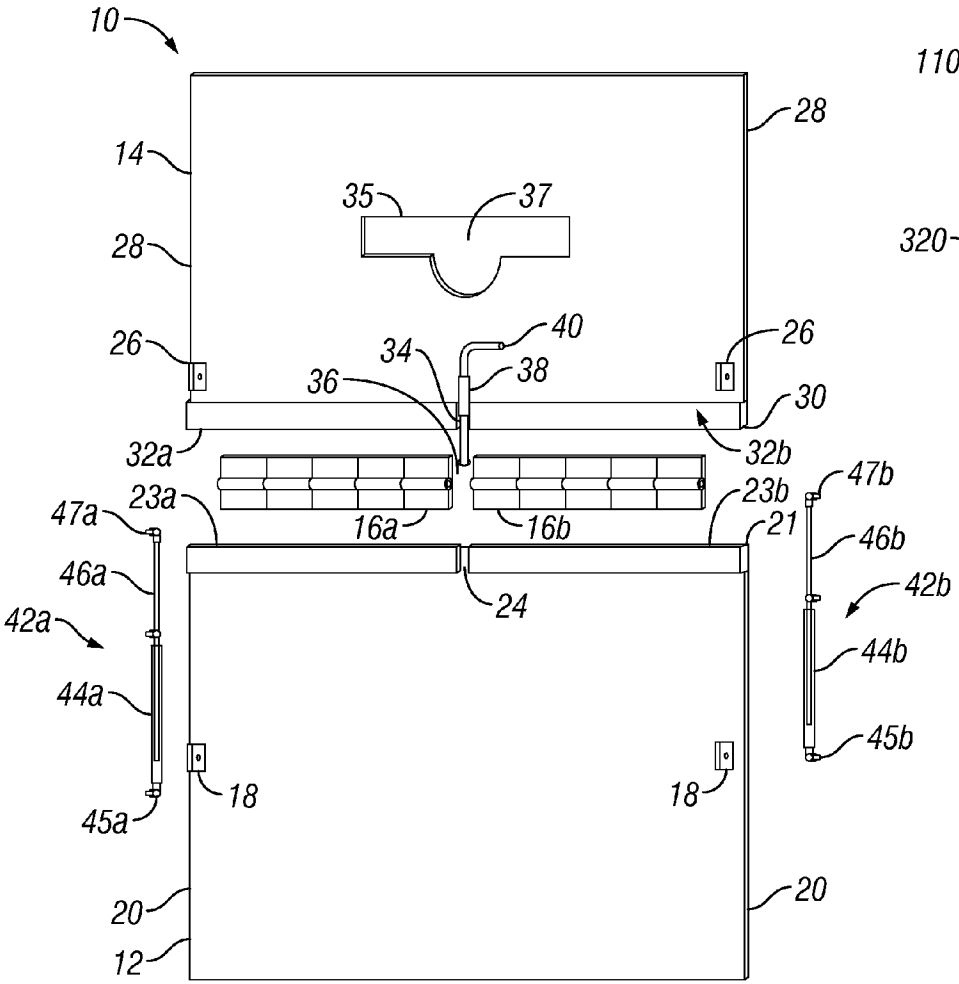
FIG. 6 is view, similar to FIG. 1, but illustrating separately the various parts thereof.

As can be best seen from FIGS. 1 and 6, the window guard and barrier device 10 of the present invention includes a fixed lower panel member 12 and a movable upper panel member 14 operatively connected to the lower panel member 12 by a pair of piano hinges 16*a*, 16*b*. Each of the lower and upper panel members 12, 14 are preferably formed of a ballistic, bullet-proof material such as armor steel. However, it should be apparent to those skilled in the art that other suitable materials may be used, such as a metallic, plastic or ceramic material. In addition, the panel members 12 and 14 may be fabricated from a composite material or a nano-material.

The fixed lower panel member 12 is substantially rectangular in shape and has a height dimension of approximately thirty-three inches and a width dimension of approximately forty-eight inches. A pair of mounting plates 18 is secured adjacent to side edges 20 of the lower panel member 12 in the mid-portion thereof. Adjacent to the top edge 21 of the lower panel member, there are affixed a pair of laterally-extending spacer members 23*a*, 23*b* which are spaced apart a predetermined distance so as to form a central opening 24 therebetween.

The movable upper panel member 14 is also substantially rectangular in shape and has a height dimension of approximately twenty-seven inches and a width dimension of approximately forty-eight inches. A pair of mounting plates 26 is secured adjacent to side edge 28 of the upper panel member 12 in the lowermost portion thereof. Adjacent to the bottom edge 30 of the upper panel member, there are affixed a pair of laterally-extending spacer members 32*a*, 32*b* which are spaced apart a predetermined distance so as to form a central opening 34 therebetween.

The upper panel member 14 is also provided with a centrally-located cut-out 35 which permits observation of the exterior of the building structure (the outer side that is susceptible to attack) from the inside (the safe side that is non-attack susceptible). The cut-out 35 is contoured in shape to serve as a gun port for extending therethrough and holding therein a barrel of a firearm. A transparent, fixed or removable shield 37 is suitably designed to cover the cut-out 35 and is made of a ballistic material.

The height and width dimensions of both of the lower and upper panel members 12 and 14 can be made larger or smaller so to accommodate different size window openings in the building structure. While the panel members have been illustrated to be rectangular in shape, it should be apparent to those skilled in the art that the panel members may be formed of a square, oval, elliptical, or circular shape as well.

The pair of piano hinges 16*a*, 16*b* are mounted on the respective spacers 23*a*, 23*b*, 32*a*, 32*b* and are used to pivotally join together the upper panel member 14 to the lower panel member 12. The piano hinges 16*a*, 16*b* permit the rotation of the upper panel member 14 relative to the lower panel member 12 for covering a window opening. The pair of piano hinges are disposed in a spaced apart relationship so as to form a central opening 36 therebetween. It will be noted that the central openings 24, 34 and 36 are in vertical alignment and adapted to receive a cane bolt sleeve 38 and a slidable cane bolt 40 therethrough.

A pair of gas spring mechanisms 42*a*, 42*b* are provided to facilitate the raising and lowering of the movable upper panel member 14. In particular, the gas spring mechanism 42*a* is mounted adjacent to the left side of the barrier device and is formed of cylinder member 44*a* and piston member 46*a*. As shown in FIG. 6, the distal free end 45*a* of the cylinder member 44*a* is operatively connected to the mounting plate 18, and the distal free end 47*a* of the piston member 46*a* is operatively connected to the mounting plate 26.

Similarly, the gas spring mechanism 42*b* is mounted adjacent to the right side of the barrier device and is formed of cylinder member 44*b* and piston member 46*b*. As shown in FIGS. 3 and 6, the distal free end 45*b* of the cylinder member 44*b* is operatively connected to the mounting plate 18, and the distal free end 47*b* of the piston member 46*b* is operatively connected to the mounting plate 26.

The operation of raising and lowering of the upper panel member 14 between the stowed position of FIG. 5 and the deployed position of FIG. 1 will now be explained. In order to deploy, the top edge 49 the upper panel member 14 is grasped and lifted upwardly or flipped-up by a user in the direction of the arrows 51 for rotating it relative to the lower panel member 12. This will cause the pair of gas spring mechanisms 42*a*, 42*b* to expand vertically so as to reduce the amount of effort (about 5 lbs.) to lift the upper panel member. Once the gas spring mechanisms are fully extended to the deployed position of FIG. 1, the cane bolt 40 is then moved vertically and downwardly through the central opening 34 in the upper panel member 14, the central opening 36 in the piano hinges 16*a*, 16*b*, and the central opening 24 in the lower panel member 12 so to maintain the upper panel member 14 in the locked or deployed position.

When stowing, the cane bolt 40 is moved vertically and upwardly through the central openings 24, 36, and 34 so as to disengage the upper panel member 14 from the locked or deployed position of FIG. 1. Next, the upper panel member will fall due to gravity to the stowed position of FIG. 4. The gas spring mechanisms serve to prevent the upper panel member from dropping suddenly or too quickly as the pistons are retracted into the respective cylinders.

With attention now directed to FIGS. 7 through 16 of the drawings, there is shown a second embodiment of a window guard and defensive barrier device 110 of the present invention. The barrier device 110 includes a fixed lower panel member 112 and a movable upper panel member 114. Each of the lower and upper panel members is also preferably formed of a ballistic, bullet-proof material such as armor steel, but may be fabricated from other suitable materials such as those described in connection with the barrier device 10.

The fixed lower panel member 112 is substantially rectangular in shape and has a height dimension of approximately thirty-three inches and a width dimension of approximately forty-eight inches. A lower attachment plate 118 is mounted adjacent to the right side edge of the lower panel member 112 in the lowermost portion thereof. The movable upper panel member 114 is also substantially rectangular in shape and has a height dimension of approximately twenty-seven inches and a width dimension of approximately forty-eight inches. An upper attachment plate 126 is mounted adjacent to the right side edge of the upper panel member 114 in the uppermost portion thereof.

The upper panel member 114 is also provided with a centrally-located cut-out 135 which permits observation of the exterior of the building structure (the outer side that is susceptible to attack) from the inside (the safe side that is non-attack susceptible). The cut-out 135 is contoured in shape to serve as a gun port for extending therethrough and holding therein a barrel of a firearm. A transparent, fixed or removable shield 137 is suitably designed to cover the cut-out 135 and is made of a ballistic material. A handle 115 is affixed adjacent to the bottom edge 117 of the upper panel member 112 in the mid-portion thereof.

A pair of drawer slider mechanisms 140*a*, 140*b* are provided to smoothly guide the raising and lowering of the upper panel member 114 in an even vertical travel. In particular, the drawer slider mechanism 140*a* is mounted adjacent to the left side of the barrier device and is formed of a guide member 142*a* and a slidable track member 144*a* telescoped within the guide member 142*a* via a plurality of ball bearings 143 disposed therebetween. The distal free end 145*a* of the guide member 140*a* is retained in place by a stop member 146*a* mounted on the front side of the lower panel member 112. The distal free end 147*a* of the track member 144*a* is operatively connected to the back side of the upper panel member 114.

Similarly, the drawer slider mechanism 140*b* is mounted adjacent to the right side of the barrier device and is formed of a guide member 142*b* and a slidable track member 144*b* telescoped within the guide member 142*b* via the plurality of ball bearings 143 disposed therebetween, as shown in FIG. 14. The distal free end 145*b* of the guide member 140*b* is retained in place by a stop member 146*b* mounted on the front side of the lower panel member 112. The distal free end 147*b* of the track member 144*b* is operatively connected to the back side of the upper panel member 114.

Figure 13:
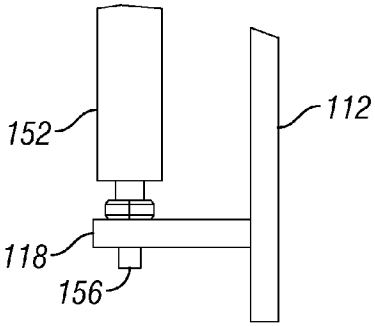
FIG. 13 is an enlarged view of the encircled portion C of FIG. 9.
Figure 11:
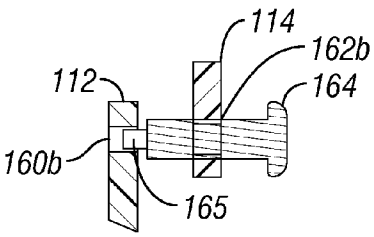
FIG. 11 is an enlarged view of the encircled portion A of FIG. 10.
Figure 12:
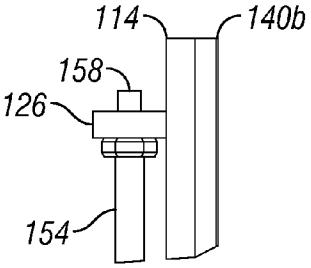
FIG. 12 is an enlarged view of the encircled portion B of FIG. 9.

A gas spring mechanism 150 is mounted adjacent to the right side of the barrier device and is formed of a cylinder member 152 and a piston member 154. The distal free end of 156 of the cylinder member 152 is operatively connected to the lower attachment plate 118, as depicted in FIG. 13. The distal free end 158 of the piston member 154 is operatively connected to the upper attachment plate 126, as depicted in FIG. 12.

Figure 16:
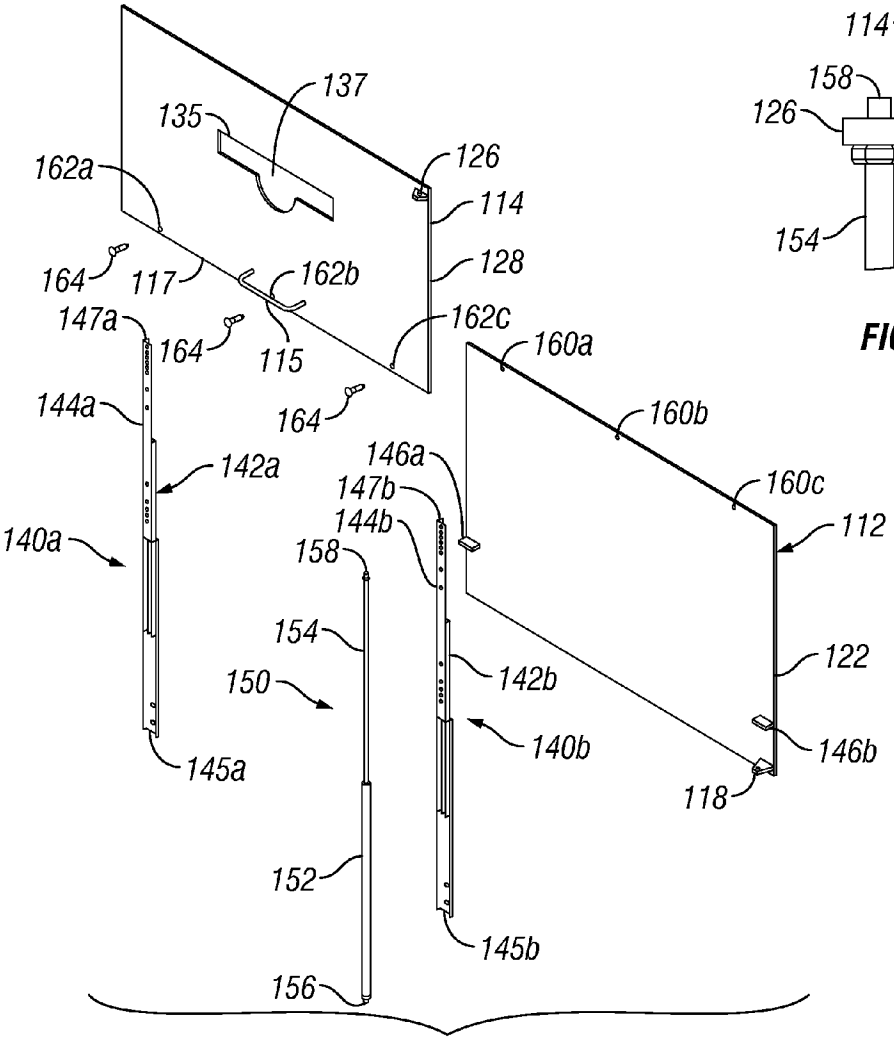
FIG. 16 is an exploded view of the barrier device of FIG. 15.

Further, as seen in FIG. 16 the lower panel member 112 is formed with a plurality of spaced-apart apertures 160*a*, 160*b*, 160*c* adjacent to its top edge thereof. The upper panel member 114 is formed with a plurality of spaced-apart tapped apertures 162*a*, 162*b*, 162*c* adjacent to its bottom edge thereof. A plurality of spring-loaded locking plungers 164 are fastened movably to the upper panel member 114 by threading the same into tapped apertures 162*a*-162*c*, one of which being shown in FIG. 11.

The operation of raising and lowering of the upper panel member 114 between the stowed position and the deployed position of FIG. 15 will now be explained. In order to deploy, the handle 115 of the upper panel member 114 is grasped and lifted upwardly by a user for sliding vertically the same relative to the lower panel member 112. This will cause the gas spring mechanism 150 to expand vertically so as to reduce the amount of effort to lift the upper panel member 114.

Simultaneously, the slidable track members 144*a*, 144*b* of the drawer slide mechanisms 140*a*, 140*b* will slide vertically and upwardly within the respective guide members 142*a*, 142*b* with even travel so as to smoothly guide the upper member to the deployed position of FIG. 15. Once the gas spring mechanism 150 is fully extended to the deployed position, the ends 165 of the locking plungers 164 (FIG. 11) will become inserted into the respective apertures 160*a*-160*c* in the lower panel member 112, thereby maintaining the upper panel member 114 in the deployed position.

When stowing, the user will pull outwardly on the plungers 164 so to disengage its ends 165 from the respective aperture 160*a*-160*c* in the lower panel member 112 while holding on to the handle 115. When the last plunger is disengaged, the upper panel member 114 will fall due to gravity to the stowed position. The gas spring mechanism 150 serves to prevent the upper panel member from dropping suddenly or too quickly as the piston is retracted into its cylinder.

In FIGS. 17 through 21 of the drawings, there is depicted a third embodiment of the window guard and defensive barrier device 210 of the present invention. The barrier device 210 includes a fixed left panel member 212*a* and a movable left panel member 214*a* pivotally connected to the fixed left panel member 212*a* by a vertically-mounted piano hinge 216*a*. The barrier device 210 further includes a fixed right panel member 212*b* and a movable right panel member 214*b* pivotally vertically-mounted piano hinge 216*b*. Each of the panel members 212*a*, 212*b*, 214*a*, 214*b* is preferably formed of a ballistic, bullet-proof material, such as armor steel. Further, each of the panel members has height dimension of approximately eighty-four inches and a width dimension of approximately of twenty-four inches.

A pair of door stop members 218*a*, 218*b* are formed adjacent to the right side edge of the left movable panel member 214*a* in a spaced-apart relationship so as to form a central opening 220 therebetween. The left movable panel member 214*a* is provided with a first centrally-located cut-out 235*a* which permits observation of the exterior of the building structure. The cut-out 235*a* is contoured in shape to serve as a gun port for extending therethrough and holding therein a barrel of a firearm. The right movable panel member 214*b* is also provided with a second centrally-located cut-out 235*b* which permits observation of the exterior of the building structure. The cut-out 235*b* is again contoured in shape to serve as a gun port for extending therethrough and holding therein a barrel of a firearm.

A plurality of cane bolt sleeves 238*a*-238*c* are mounted in the left and right movable panel members 214*a*, 214*b*. In addition, a cane bolt 240 is mounted in the left movable panel member 214*a*. In particular, the cane bolt sleeve 238*a* is mounted in the left movable panel member 214*a*. The cane bolt sleeve 238*b* is affixed within the central opening 220 formed by the door stop members 218*a*, 218*b*. The cane bolt sleeve 238*c* is formed in the movable right panel member 214*b*.

Figure 20:
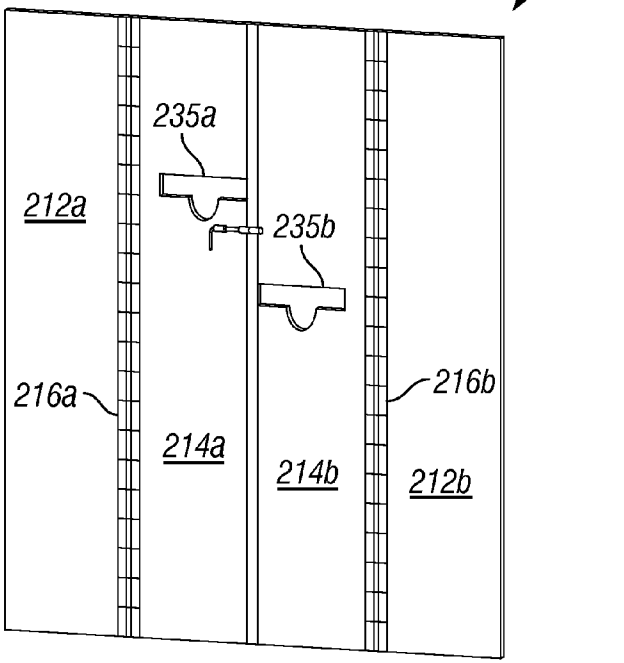
FIG. 20 is a perspective view of the barrier device of FIG. 17.
Figure 19:
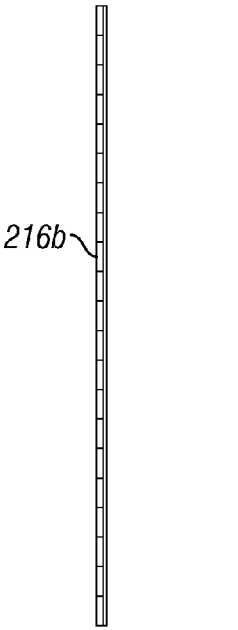
FIG. 19 is right side view of the barrier device of FIG. 17.
Figure 18:
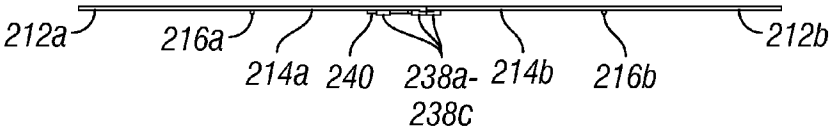
FIG. 18 is top end view of the barrier device of FIG. 17.
Figure 17:
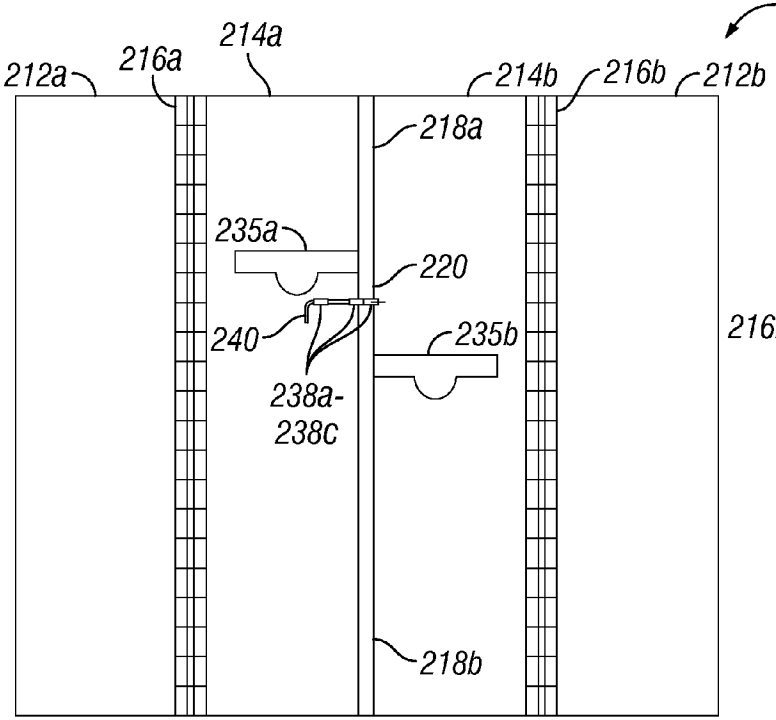
FIG. 17 is front plan view of a third embodiment of a window guard and barrier device in the deployed position, constructed in accordance with the principles of the present invention.

The tandem operation of moving the left and right movable panel members 214*a*, 214*b* from a stowed position to a deployed position of FIG. 20 will now be explained. In order to deploy, the movable right panel member 214*b* is pivotally rotated to the left about the piano hinge 216*b* relative to the fixed right panel member 214*b* for covering partially a window opening. Similarly, the movable left panel member 214*a* is pivotally rotated to the right about the piano hinge 216*a* relative to the fixed right panel member 214*a* for covering partially the window opening. As a result, the side edges of right and left movable panel members 214*b*, 214*a* will abut each other and be covered by the door stop members 218*a*,

218*b*. Then, the cane bolt 240 is slid to the right so as to pass through the respective sleeves 238*a*-238*c*, thereby locking the right and left movable panel members in the deployed position.

When stowing, the cane bolt 240 is slid to the left so as to disengage the same from the respective sleeves 238*a*-238*c*. Then, the movable left panel member 214*a* is pivotally rotated to the left about the piano hinge 216*a* relative to the fixed left panel member 214*a*. Finally, the movable right panel member 214*b* is pivotally rotated to the right about the piano hinge 216*b* relative to the fixed right panel member 214*b*.

Figure 24:
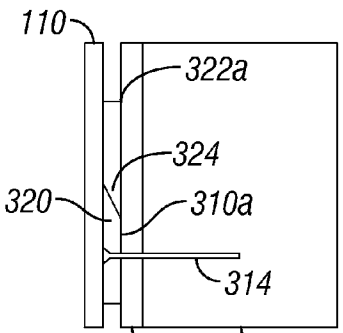
FIG. 24 is an enlarged view of the encircled portion E of FIG. 23.
Figure 22:
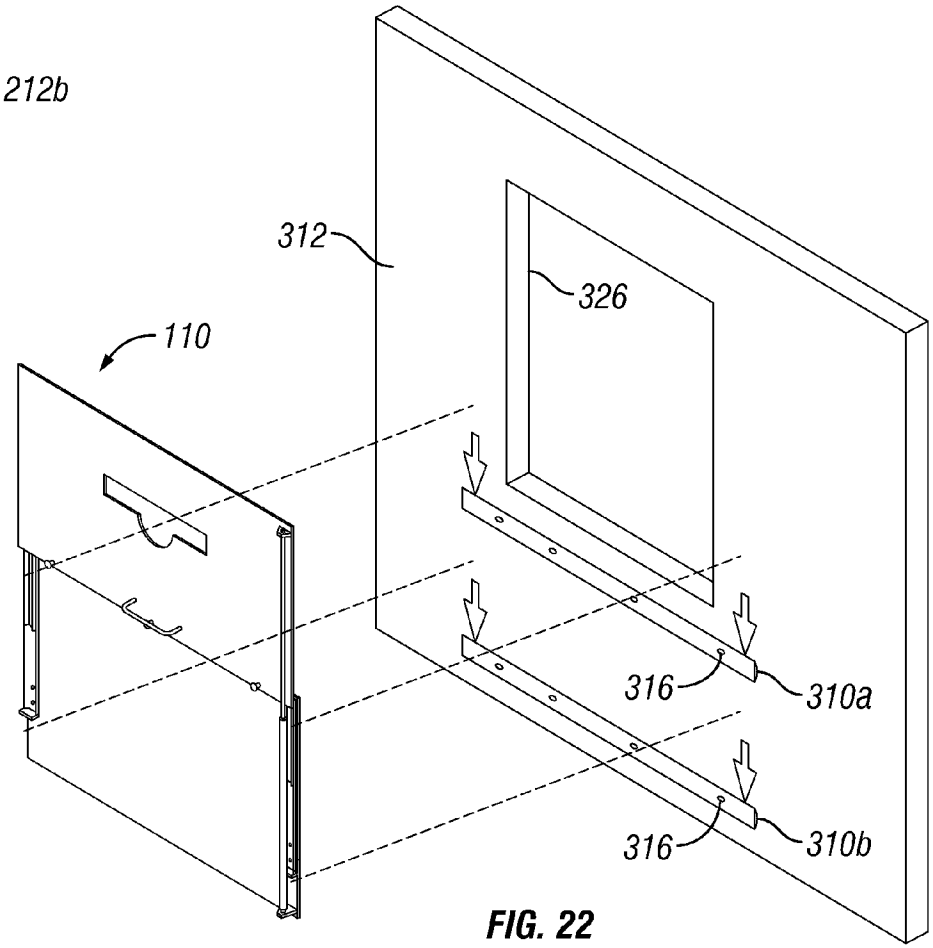
FIG. 22 is a perspective view, illustrating one method of installing the barrier device of FIG. 7 to an interior dry wall via co-mating mounting brackets.
Figure 21:
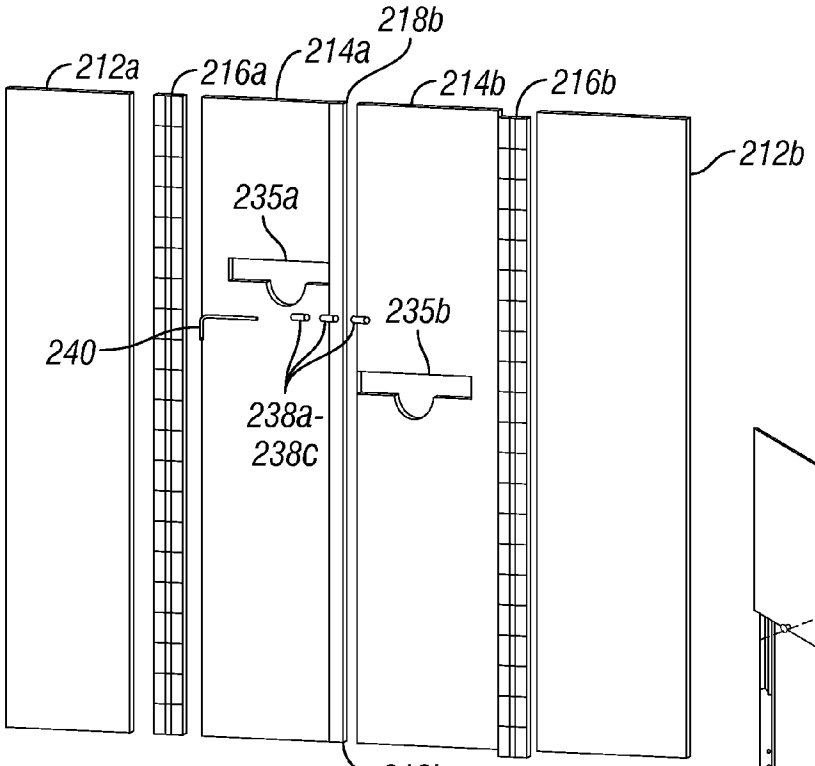
FIG. 21 is an exploded view of the barrier device of FIG. 20.

Referring now to FIGS. 22 through 24 of the drawings, there is illustrated one method of installing quickly the barrier device 110 of FIG. 15 to an interior dry wall via co-mating mounting brackets. Specifically, a first pair of upper and lower mounting brackets 310*a*, 310*b* are securely fixed in a spaced apart relationship on an interior dry wall 312 via screws 314. The screws 314 are inserted through the holes 316 in the mounting brackets 310*a*, 310*b* and are then threaded into the dry wall 312 and wall stud 318. Each of the mounting brackets 310*a*, 312*b* is provided with an upwardly-extending angled projection 320.

A second pair of mounting brackets 322*a*, 322*b* are suitable secured to the upper and lower panel members of the barrier device 110. Each of the mounting brackets 322*a*, 322*b* is provided with a downwardly-extending angled projection 324. In order to install the barrier device 110, the downwardly-extending angled projections 324 on the second pair of mounting brackets 322*a*, 322*b* are placed to co-mate in a contacting engagement with the upwardly-extending angled projections 320 on the first pair of mounting brackets 310*a*, 310*b*. In this manner, the barrier device 110 is removably secured to the dry wall 312 so as to cover a window opening 326.

From the foregoing detailed description, it should be clearly understood that the optimum dimensional relationship for the particular elements or components of the present invention may include variations in size, material, shape, form, function, and manner of operation. Further, those skilled in the art will appreciate that the technique described above for installation of the barrier device of the present invention is not fundamental to the purposes and intents thereof and other installation methods may be used without violating the spirit of the invention.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

The invention claimed is:

1. A window guard and defensive barrier device for protecting and/or shielding personnel within the interior of a building structure against firing of projectiles through a window opening, said barrier device comprising:

a fixed lower panel member being formed of a ballistic, bullet-proof material;

a movable upper panel member being also formed of a ballistic, bullet-proof material;

sliding means for slidingly connecting said movable upper panel member to said fixed lower panel member so as to guide smoothly the vertical movement of said movable upper panel member relative to said fixed lower panel member for covering the window opening;

means operatively connected to said upper and lower panel members for facilitating the vertical movement of said upper panel member between a stowed position and a deployed position; and locking means formed on said upper panel member and being movable into contact engagement with said lower panel member for maintaining said upper panel member in the deployed position.

2. A barrier device for protecting and/or shielding personnel as claimed in claim 1, wherein said ballistic material of said upper and lower panel members is made of armor steel.

3. A barrier device for protecting and/or shielding personnel as claimed in claim 1, wherein said upper panel member is provided with a centrally-located cut-out which serves as a viewing slot to permit observation of the exterior of the building and/or a gun port for extending therethrough and holding therein the barrel of a firearm.

4. A barrier device for protecting and/or shielding within the interior of a building structure against firing of projectiles through a window opening, said barrier device comprising:

a fixed lower panel member being formed of a ballistic, bullet-proof material;

a movable upper panel member being also formed of a ballistic, bullet-proof material;

a pair of drawer slide mechanisms operatively connected to said movable upper panel member and to said fixed lower panel member, said pair of drawer slide mechanisms guiding smoothly the vertical movement of said movable upper panel member relative to said fixed lower panel member for covering the window opening;

each of said pair of drawer slide mechanisms being formed of a guide member and a track member disposed slidably within said guide member;

a gas spring mechanism formed of a cylinder and a piston and being operatively connected to said upper and lower panel members, said gas spring mechanism facilitating the vertical movement of said upper panel member between a stowed position and a deployed position; and a plurality of spring-loaded locking plungers affixed to said upper panel member and being received in apertures formed in said lower panel member so as to maintain said upper panel member in the deployed position.

5. A barrier device for protecting and/or shielding personnel as claimed in claim 1, further comprising first bracket means having downwardly-extending projections formed on said upper and lower panel members for rapid installation to second bracket means having upwardly-extending projections secured on a drywall below the window opening.

* * * * *